US012252220B2

(12) United States Patent
Wang

(10) Patent No.: US 12,252,220 B2
(45) Date of Patent: Mar. 18, 2025

(54) ELECTRIC FIN AND WATER TRANSPORT INSTRUMENT

(71) Applicant: Oriental Recreational Products (Shanghai) Co., LTD, Shanghai (CN)

(72) Inventor: Zhiyue Wang, Shanghai (CN)

(73) Assignee: Oriental Recreational Products (Shanghai) Co., LTD, Shanghai (CN)

( * ) Notice: Subject to any disclaimer, the term of this patent is extended or adjusted under 35 U.S.C. 154(b) by 471 days.

(21) Appl. No.: 17/628,406

(22) PCT Filed: Jul. 27, 2020

(86) PCT No.: PCT/CN2020/104879
§ 371 (c)(1),
(2) Date: Jan. 19, 2022

(87) PCT Pub. No.: WO2021/018090
PCT Pub. Date: Feb. 4, 2021

(65) Prior Publication Data

US 2022/0315175 A1 Oct. 6, 2022

(30) Foreign Application Priority Data

Jul. 29, 2019 (CN) ..... 201910688531.7

(51) Int. Cl.
*B63B 32/60* (2020.01)
*B63B 32/10* (2020.01)
*B63H 23/24* (2006.01)

(52) U.S. Cl.
CPC ..... *B63B 32/60* (2020.02); *B63B 32/10* (2020.02); *B63H 23/24* (2013.01)

(58) Field of Classification Search
CPC ..... B63B 32/10; B63B 32/60; B63B 32/64; B63H 1/16; B63H 5/14; B63H 5/15;
(Continued)

(56) References Cited

U.S. PATENT DOCUMENTS 2,965,065 A * 12/1960 Tinker ..... B63H 11/08 60/221
3,389,558 A * 6/1968 Hall ..... B63H 11/08 60/221

(Continued)

FOREIGN PATENT DOCUMENTS

CN 103786853 5/2014
CN 106143824 11/2016

(Continued)

OTHER PUBLICATIONS

"PCT International Search Report", PCT International Application No. PCT/CN2020/104879 filed on Jul. 27, 2020, mailed on Oct. 14, 2020, Beijing China (3 pages).

*Primary Examiner* — Ajay Vasudeva
(74) *Attorney, Agent, or Firm* — Woods Oviatt Gilman LLP; Katherine H. McGuire, Esq.

(57) ABSTRACT

This present invention relates to an electric fin and a water sports instrument, wherein the electric fin comprises a housing extending along a first direction and having a water inlet cavity; and a propeller and a guide member sequentially arranged in the first direction, wherein the propeller is located in the water inlet cavity, at least part of the guide member is located in the water inlet cavity, the water flow in the water inlet cavity flows out of the guide member; the propeller is provided with a propeller shaft and a plurality of blades, the propeller shaft extends in the first direction, and the plurality of blades are spaced around a circumference of the propeller shaft; the guide member is provided with a guide shaft and a plurality of flow deflectors, the guide shaft extends in the first direction and the plurality of flow deflectors are spaced around a circumference of the guide shaft; the propeller shaft and the guide shaft having an outer contour S with a taper which gradually decreases along a second direction from said second end portion of the pro-
(Continued)

peller shaft toward said flow guide. The electric fin of the present invention has sufficient power and good guiding performance.

12 Claims, 10 Drawing Sheets

(58) Field of Classification Search
CPC ..... B63H 5/16; B63H 5/165; B63H 11/08; B63H 2011/081; B63H 2011/082; B63H 2011/084; B63H 2011/085; B63H 2011/087; B63H 23/24
See application file for complete search history.

(56) References Cited

U.S. PATENT DOCUMENTS

| | | | | |
|---|---|---|---|---|
| 3,849,982 | A * | 11/1974 | Hall | B63H 11/08 415/128 |
| 3,885,516 | A * | 5/1975 | Uroshevich | B63B 32/10 440/88 M |
| 5,389,021 | A * | 2/1995 | Padgett | B63H 5/14 440/71 |
| 9,981,728 | B2 | 5/2018 | Woodruff | |
| 10,000,266 | B1 * | 6/2018 | Terada | B63H 11/08 |
| 10,266,239 | B2 | 4/2019 | Fry | |

FOREIGN PATENT DOCUMENTS

| | | |
|---|---|---|
| CN | 208069989 | 11/2018 |
| CN | 109421911 | 3/2019 |
| CN | 210653565 | 6/2020 |
| CN | 210653566 | 6/2020 |
| CN | 210681072 | 6/2020 |
| CN | 210912790 | 7/2020 |
| DE | 3735409 | 5/1989 |

* cited by examiner

ELECTRIC FIN AND WATER TRANSPORT INSTRUMENT

TECHNICAL FIELD

The present invention relates to water sports equipment, and specifically to an electric fin and a water sports instrument.

BACKGROUND

One or more fins usually need to be installed on the bottom of existing water sports instruments such as surfboards, SUPs or inflatable boats to enhance an effect of breaking waves and flexibility of changing directions when surfers use the surfboards.

For example, patent number CN109956015A discloses a power-assisted propeller for water sports, including: at least one supporting plate and at least one power-assisted propeller main bodies correspondingly matched with each supporting plate. The back surface of a bottom plate of a water sports carrier is provided with first clamping grooves. The front surface of each supporting plate is buckled on the corresponding first clamping grooves and fixed through first bayonet locks. The back surface of the supporting plate is provided with second clamping grooves used for fixing the corresponding power-assisted propeller main bodies. The power-assisted propeller main bodies are buckled on the corresponding second clamping grooves and are fixed through corresponding second bayonet locks. In the present invention, it is convenient for the power-assisted propeller to be arranged on the water sports carrier. Meanwhile, it is convenient for the power-assisted propeller to be disassembled and the handheld diving is facilitated by the power-assisted propeller. The electric control turning can be implemented and the overwater sports life is enriched.

For example, patent number CN201012744Y discloses an electric surfboard. A tail part of the electric surfboard is thickened. A motor is installed inside the thickened part. A shaft of the motor is stretched out from the tail part of the surfboard. The shaft is sleeved on a turbine. An upper surface on the thickened section of the surfboard is equipped with an active cover. A user can open the active cover to fetch out the motor and the turbine when in use, and then the surfboard can be normally used to do water skiing sports. In order to save physical strength, the user can install the motor on the tail part of the surfboard. When the switch is closed, the motor drives the turbine to rotate for drainage, so that the paddleboard is made to move forward, and the user can crawl onto the surfboard and control the direction by hands.

The existing electric fins are fixed on the water sports instrument bottom, leading to insufficient power and poor using experience.

SUMMARY

The problem solved by the present invention is that power of existing electric fins is insufficient.

In order to solve the problem, an objective of the present invention is to provide an electric fin, comprising: a housing, extending in a first direction and having a water inlet cavity, and a propeller and a flow guide sequentially arranged in said first direction, wherein said propeller is located in said water inlet cavity, at least part of said flow guide is located in said water inlet cavity, water flow in said water inlet cavity flows out of said flow guide; said propeller is provided with a propeller shaft including a first end portion, a second end portion, and a plurality of blades, said propeller shaft extends in said first direction, and said plurality of blades being spaced around a circumference of said propeller shaft, each of said plurality of blades having a height "H" and extending helically about at least a portion of said propeller shaft and having a decreasing taper in said height H in a direction toward said flow guide; said flow guide is provided with a guide shaft and a plurality of flow deflectors, said guide shaft extends in said first direction and said plurality of flow deflectors being spaced around a circumference of said guide shaft; said propeller shaft and said guide shaft having an outer contour S with a taper which decreases gradually along a second direction from said second end portion of the propeller shaft toward said flow guide.

Optionally, said projection is tapered.

Optionally, said propeller shaft is in a truncated cone shape, said guide shaft is in a truncated cone shape.

Optionally, the transverse cross sectional area of said propeller shaft decreases gradually in said second direction from a second end portion of said propeller shaft to a first end portion of said propeller shaft, the transverse cross sectional area of said guide shaft decreases gradually in said fourth second direction from a second end portion of said guide shaft to a first end portion of said guide shaft, and said first end portion of said propeller shaft and said second end portion of said guide shaft are disposed adjacent to one another in said first direction.

Optionally, said first end portion of said propeller shaft is fitted or in clearance fit with said second end portion of said guide shaft, said first end portion of said propeller shaft has a cross section having the same outer contour shape as that of the cross section of said second end portion of said guide shaft, and projection said first end portion of said propeller shaft coincides with projection of said second end portion of said guide shaft in the first direction; or, the outer contour shape of the cross section of said second end portion of said guide shaft is scaling down relative to the outer contour shape of the cross section of said first end portion of said guide shaft.

Optionally, the electric fin further comprises a driving member, wherein said driving member, said propeller and said flow guide are arranged in sequence in said first direction, at least part of said driving member is located in said water inlet cavity, said driving member drives said propeller to rotate;

along said first direction, said propeller shaft comprises a second end portion, said driving member comprises a first end portion, said second end portion of said propeller shaft is in clearance fit with said first end portion of said driving member in said first direction, said second end portion has a cross section having the same outer contour shape as that of a cross section of said first end portion, and projection said second end portion coincides with projection of said first portion in the first direction; or, the outer contour shape of the cross section of said second end portion of said propeller shaft is scaling down relative to the outer contour shape of the cross section of said first end portion of said driving member.

Optionally, one end of each blade along its extension direction is flush with the edge of said second end portion.

Optionally, the outer contour shape of the cross section of the part of said driving member located in said water inlet cavity is the same as the outer contour shape of the cross section of said first end portion.

Optionally, said flow guide is provided with an annular wall, said annular wall is fitted with the inside wall of said housing, each flow deflector has one end that is connected to said interior surface of said annular wall, and the other end portion that is connected to said guide shaft, and the inside wall of said annular wall has a transverse cross sectional area that decreases gradually along said second direction.

Optionally, the annular wall has a transverse cross sectional area that decreases gradually from the second end portion to the first end portion of said annular wall along said second direction, the water flow in said water inlet cavity flows into said flow guide from said second end portion and flows out of said flow guide from said first end portion.

Optionally, the water in said water inlet cavity flows out of said flow guide along said first direction.

Optionally, each said flow deflector along its extension direction has one end that is flush with the edge of said second end portion of said guide shaft, and said second end portion of said guide shaft is disposed facing said propeller shaft.

Optionally, along said first direction, one end of said housing away from said flow guide is provided with a plurality of first water inlets, said plurality of said first water inlets are spaced around a circumference of said housing; and/or, the outer surface of said housing is provided with a plurality of second water inlets, and said plurality of said second water inlets are spaced around a circumference of the outer surface of said housing.

The present invention further provides a water sports instrument, comprising a bearing part and the above electric fin, wherein said electric fin is mounted on one side of said bearing part facing the water flow.

As mentioned, the present invention provides an electric fin, comprising: a housing, extending in a first direction and having a water inlet cavity, and a propeller and a flow guide sequentially arranged in said first direction, wherein said propeller is located in said water inlet cavity, at least part of said flow guide is located in said water inlet cavity, water flow in said water inlet cavity flows out of said flow guide; said propeller is provided with a propeller shaft and a plurality of blades, said propeller shaft extends in said first direction, and said plurality of blades are spaced around a circumference of said propeller shaft, each of said plurality of blades having a height "H" and extending helically about at least a portion of said propeller shaft and having a decreasing taper in said height H in a direction toward said flow guide; said flow guide is provided with a guide shaft and a plurality of flow deflectors, said guide shaft extends in said first direction and a plurality of flow deflectors are spaced around a circumference of said guide shaft; said propeller shaft and said guide shaft having an outer contour S with a taper which decreases gradually along a second direction from said second end portion of the propeller shaft toward said flow guide.

On the one hand, due to the provision of the flow guide, after the water flow at a high speed is spun into the flow guide from the water inlet cavity, the water flow is guided by the flow deflectors and flows out of the flow guide in the first direction, which enhances the guide property of the electric fin; on the other hand, since the propeller shaft and the guide shaft having an outer contour S with a taper which decreases gradually along the second direction from said second end portion of the propeller shaft toward said flow guide, thus the water flow entering into the water inlet cavity converges to the water inlet cavity center and extrudes. When the water flow rate is constant, the water flow is spun into the flow guide in an accelerated and pressurized manner and flows out from the flow guide, assisting in increasing the pressure and speed, thus enhancing the power of the electric fin.

In order to make the above content of the present invention more obvious and understandable, preferred embodiments are described in detail below with reference to the accompanying drawings.

DETAILED DESCRIPTION OF THE EMBODIMENTS

Figure 1:
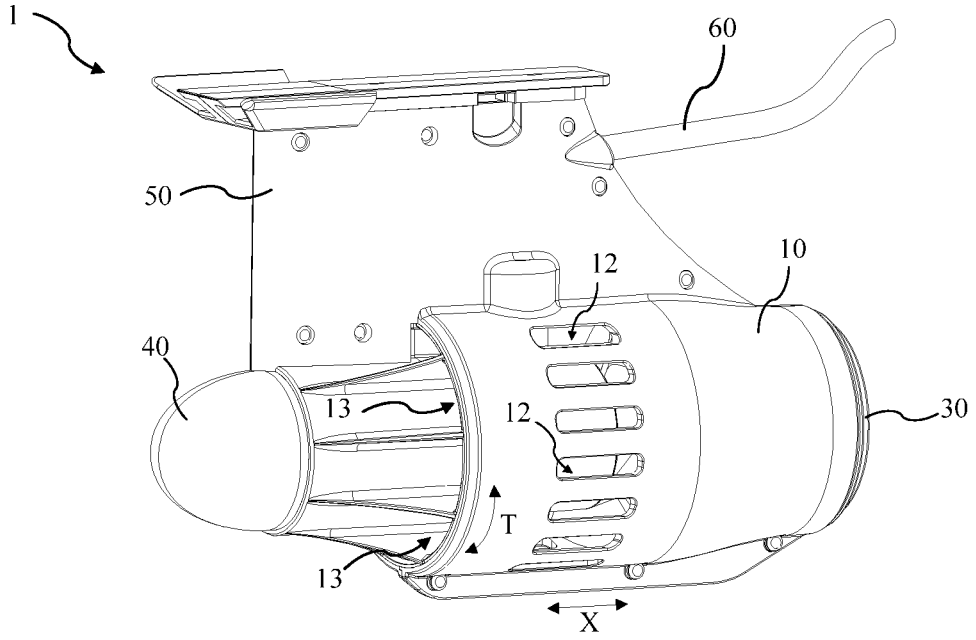
FIG. 1 is a three-dimensional view I of an electric fin of an embodiment of the present invention.
Figure 2:
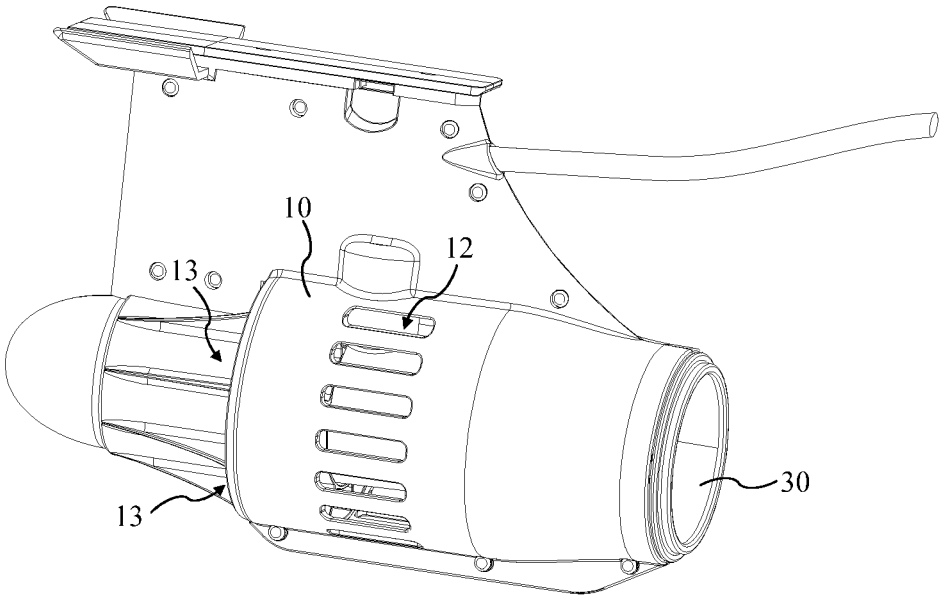
FIG. 2 is a three-dimensional view II of an electric fin of an embodiment of the present invention.

The following specific embodiments illustrate implementations of the present invention, and those skilled in the art can easily understand other advantages and effects of the present invention from the content disclosed in this description. Although the description of the present invention is introduced in conjunction with the preferred embodiments, this does not mean that the features of the present invention are limited to this implementation. On the contrary, the purpose of introducing the invention in combination with the embodiments is to cover other options or modifications that may be extended based on the claims of the present invention. In order to provide an in-depth understanding of the present invention, the following description contains many specific details. The present invention can also be implemented without using these details. In addition, in order to avoid confusion or obscuring the focus of the present invention, some specific details are omitted in the description. It should be noted that the embodiments of the present invention and the features in the embodiments can be combined with each other if there is no conflict.

Referring to FIGS. 1-6, the present invention provides an electric fin 1, including: a housing 10, extending in a first direction (shown in the X-direction in FIGS. 1 and 4-6), has a water inlet cavity 11 for the entry of the water flow; and a propeller 20 and a flow guide 30, arranged sequentially along said first direction. Preferably, the propeller 20 and the flow guide 30 are fitted in the first direction. Further, preferably, the propeller 20 and the flow guide 30 are in clearance fit along the first direction, and the clearance is small. Preferably, the clearance between the propeller 20 and the flow guide 30 in the first direction is between 0.5 mm and 2 mm, including 0.5 mm and 2 mm.

Said propeller 20 is located in said water inlet cavity 11, at least part of said flow guide 30 is located in said water inlet cavity 11, the water flow in said water inlet cavity 11 flows out of said flow guide 30. Preferably, along the first direction, one end of the flow guide 30 is located in the water inlet cavity 11, and the other end extends out of the water inlet cavity 11. In this embodiment, the housing 10 is arranged around the propeller 20, i.e., the propeller 20 is completely located in the housing. In the present embodiment, the housing 10 is provided to surround the propeller 20, thus the propeller 20 is disposed fully inside the housing 10. The flow guide 30 is partially located outside the housing 10.

Figure 3:
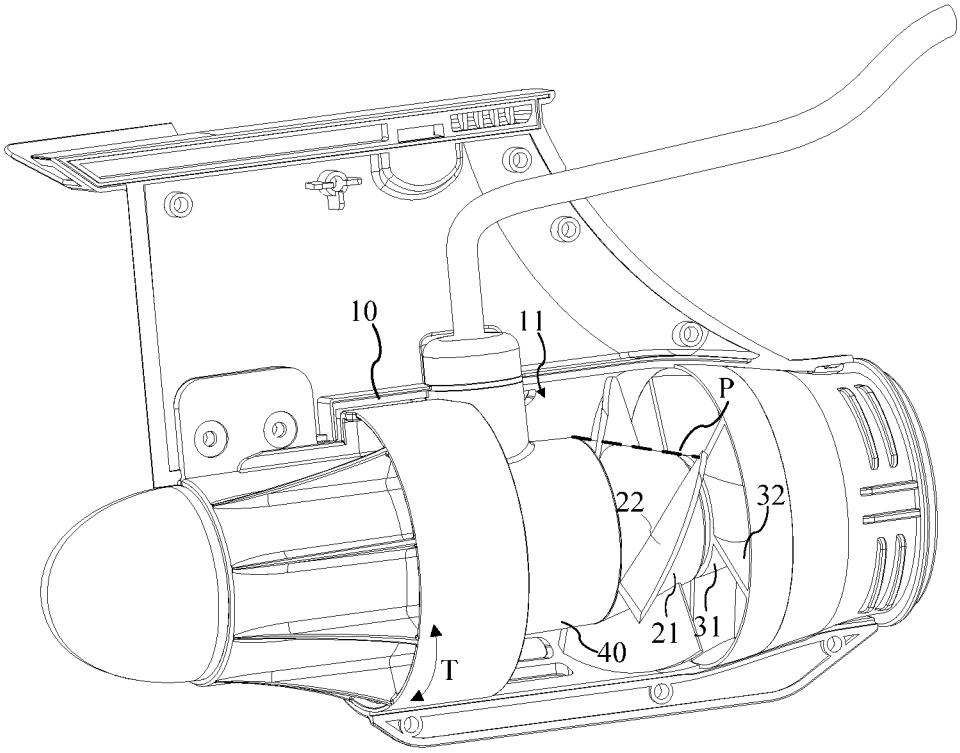
FIG. 3 is a three-dimensional view III of an electric fin of an embodiment of the present invention.

Referring to FIGS. 3-4 and 7-9, said propeller 20 is provided with a propeller shaft 21 and a plurality of blades 22, said propeller shaft 21 extends in said first direction, and the plurality of blades 22 are provided around a circumference of said propeller shaft 21 (shown in the T-direction in FIG. 3). Referring to FIGS. 3 and 10-12, the flow guide 30 is provided with a guide shaft 31 and a plurality of flow deflectors 32, said guide shaft 31 extends in said first direction, and said plurality of flow deflectors 32 are provided around a circumference of said guide shaft 31 (shown in the T-direction in FIG. 3).

Figure 5:
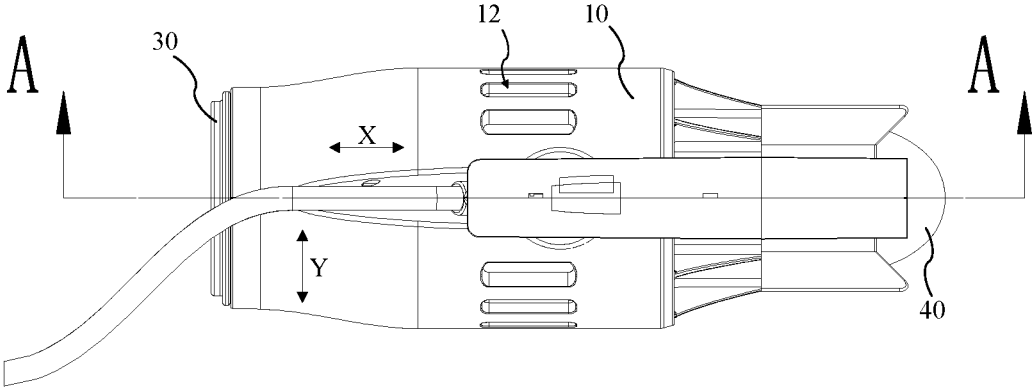
FIG. 5 is a top view of an electric fin of an embodiment of the present invention.
Figure 6:
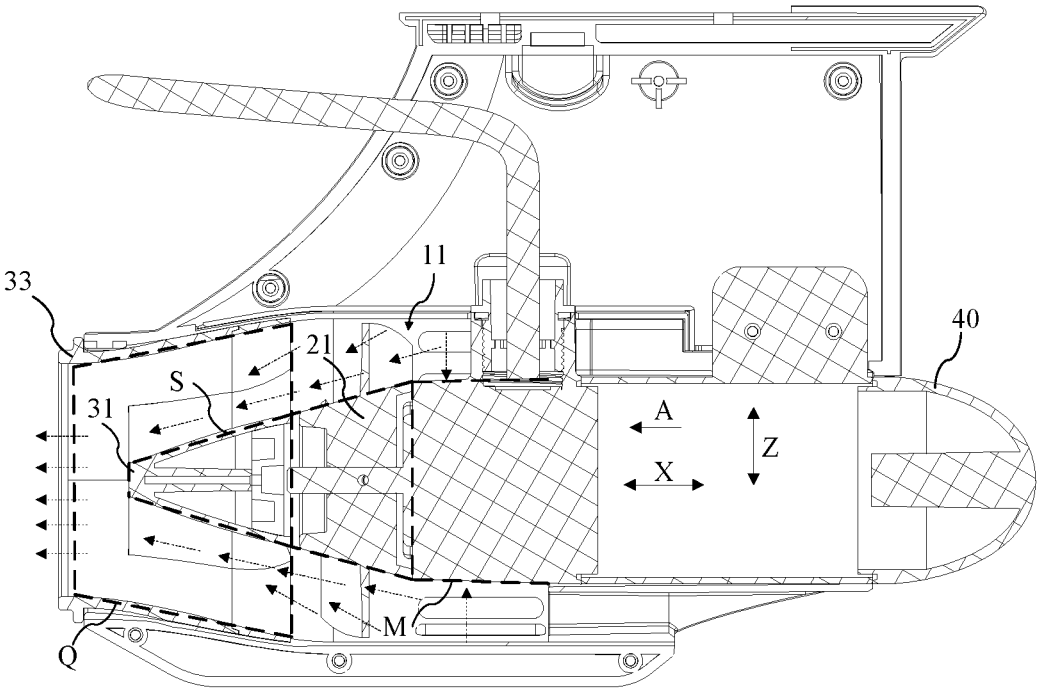
FIG. 6 is a cutaway view in the A-A direction in FIG. 5.

Referring to FIGS. 5-6, said propeller shaft 21 and said guide shaft 31 (shown by the dashed box S in FIG. 6) having an outer contour S with a taper which decreases gradually along a second direction (shown in the A direction in FIG. 6), said second direction is the direction from said propeller 20 to said flow guide 30 and is also the direction where the water flow flows out of said flow guide 30.

That is, the propeller shaft 21 and the guide shaft 31 are designed to be tapered in the second direction, and have an outer contour with a taper which gradually decrease in size; that is, the transverse cross sectional area of the propeller shaft 21 and the guide shaft 31 decrease along the second direction. Referring to FIG. 3, a tangent line to the outer contour of said propeller shaft 21 and said guide shaft 31 is drawn (shown as P in FIG. 3), and the tangent line shows a downward trend, representing the gradual size decrease of the propeller shaft 21 and the guide shaft 31.

Under this arrangement, on the one hand, due to the provision of the flow guide 30, after the water flow at a high speed is spun into the flow guide 30 from the water inlet cavity 11, the water flow is guided by the flow deflectors 32 and flows out of the flow guide 30 in the first direction, that is, said water flow of the water inlet cavity 11 flows out of said flow guide 30 along said first direction, so that guiding of the high-speed whirling water flow on the water inlet cavity 11 is implemented, which enhances the guiding performance property of the electric fin 1. On the other hand, since said propeller shaft 21 and said guide shaft 31 having an outer contour S with a taper which decreases gradually along the second direction, the water flow entering into the water inlet cavity 11 converges to the water inlet cavity center and extrudes (shown by the dashed arrow in FIG. 6) instead of spreading out. When the water flow rate is constant, the water flow spirals into and flows out of the flow guide 30 in an accelerated and pressurized manner, assisting in increasing the pressure and speed, leading to the enhancement of the electric fin 11 power.

Preferably, said projection is tapered. Further, preferably, said propeller shaft 21 is in a truncated cone shape, and said guide shaft 31 is in a truncated cone shape, that is, the projection of the propeller shaft 21 along the second direction is trapezoidal in shape (as shown in the dashed box of FIG. 9), and the projection of the guide shaft 31 along the second direction is trapezoidal in shape.

Figure 9:
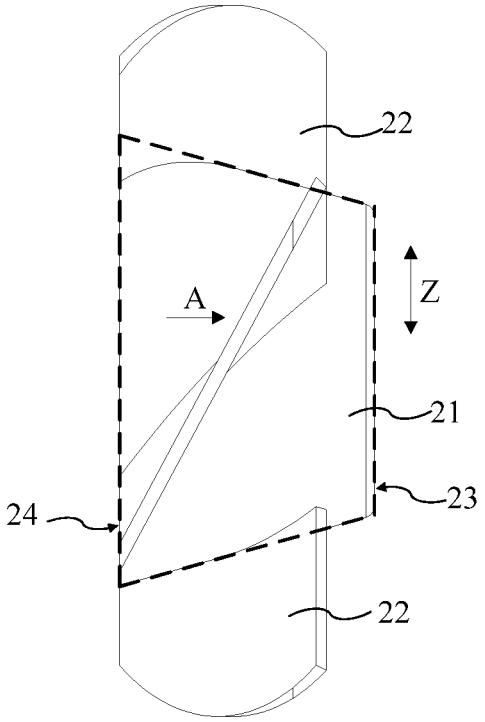
FIG. 9 is a side view II of a propeller in an electric fin of an embodiment of the present invention.
Figure 10:
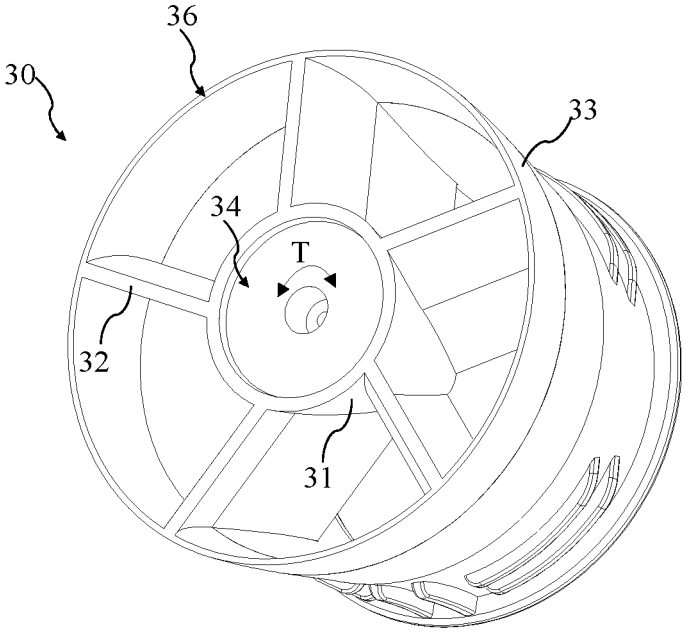
FIG. 10 is a three-dimensional view I of a flow guide in an electric fin of an embodiment of the present invention.
Figure 11:
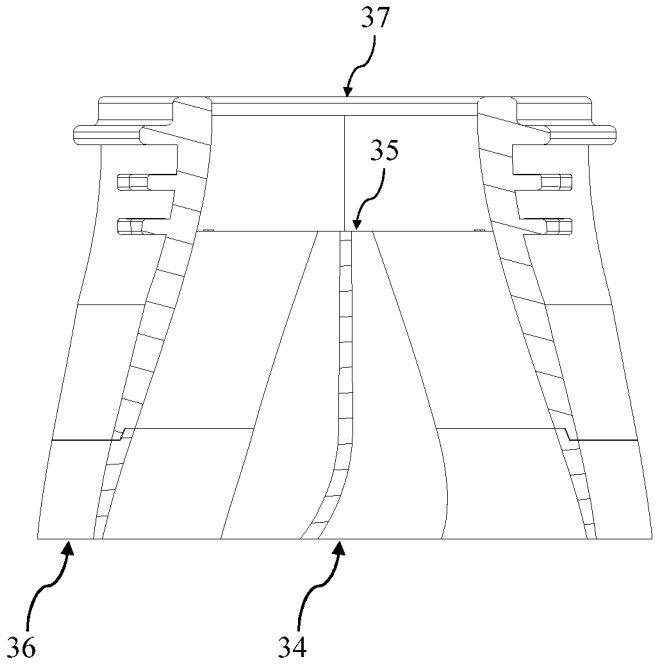
FIG. 11 is a side view of a flow guide in an electric fin of an embodiment of the present invention.
Figure 12:
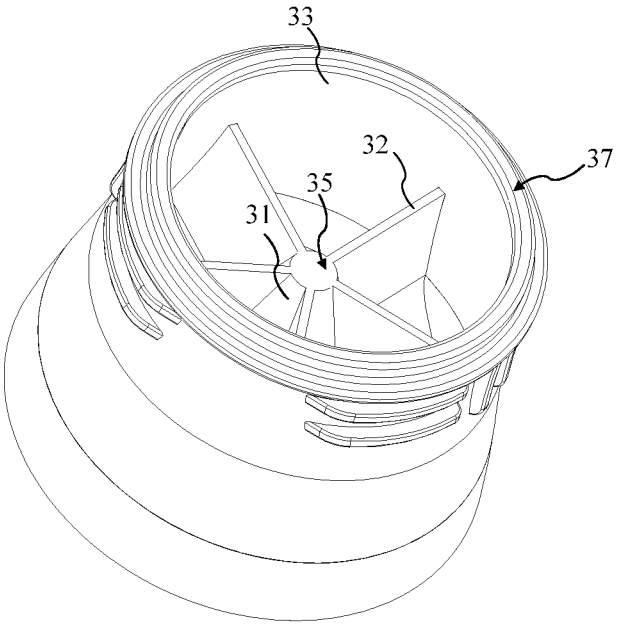
FIG. 12 is a three-dimensional view II of a flow guide in an electric fin of an embodiment of the present invention.

Referring to FIGS. 6-9, along the first direction, the propeller shaft 21 has a first end portion 23 and a second end portion 24, and the first end portion 23 and the second end portion 24 are on opposite sides of the propeller shaft 21. Referring to FIGS. 10-12, along the first direction, the guide shaft 31 has a first end portion 35 and a second end portion 34, and the first end portion 35 and the second end portion 34 are on opposite sides of the guide shaft 31.

Preferably, the transverse cross sectional area of said propeller shaft 21 decreases gradually in said second direction from the second end portion 24 of said propeller shaft 21 to the first end portion 23 of said propeller shaft 21, the transverse cross sectional area of said guide shaft 31 decreases gradually in said second direction from the second end portion 34 of said guide shaft 31 to the first end portion 35 of said guide shaft 31, and said first end portion 23 of said propeller shaft 21 and said second end portion 34 of said guide shaft 31 are disposed opposite in said first direction. Preferably, said first end portion 23 of said propeller shaft 21 and said second end portion 34 of said guide shaft 31 are fitted along said first direction. Preferably, the cross section of said propeller shaft 21 is circular in shape, and the cross section of said guide shaft 31 is circular in shape.

As an equivalent embodiment of the present invention, the propeller shaft 21 is tapered along the second direction, so that the water flow entering into the water inlet cavity 11 converges to the water inlet cavity center and extrudes instead of spreading out, which helps that the water flow spirals into and flows out of the flow guide 30 with increased speed and pressure. The guide shaft 31 is tapered along the second direction, after spiraling into the flow guide 30 with increased speed and pressure, the water flow in the water inlet cavity 11 converges to the water inlet cavity center and extrudes instead of spreading out, the water flow flows out of the flow guide 30 with further increased speed and pressure, leading to the enhancement of the electric fin 11 power.

Preferably, said first end portion 23 of said propeller shaft 21 and said second end portion 34 of said guide shaft 31 are fitted, said first end portion 23 of said propeller shaft 21 has a cross section having the same outer contour shape as that of the cross section of said second end portion 34 of said guide shaft 31. The projection of said first end portion 23 of said propeller shaft 21 and the projection of said second end portion 34 of said guide shaft 31 coincide along said first direction. That is, referring to FIGS. 3 and 7, the propeller shaft 21 and the guide shaft 31 are in seamless connection, and they as a whole are streamlined, assisting in the water flow entering the water inlet cavity 11 converges to the water inlet cavity center and extrudes instead of spreading out, and then the water flow spirals into the flow guide 30 with increased speed and pressure.

Further, preferably, said first end portion 23 of said propeller shaft 21 and said second end portion 34 of said guide shaft 31 are in clearance fit. Preferably, the clearance in the first direction between said first end portion 23 of said propeller shaft 21 and said second end portion 34 of said guide shaft 31 is between 0.5 mm and 2 mm, including 0.5 mm and 2 mm. More preferably, the outer contour shape of the cross section of said second end portion 34 of said guide shaft 31 is scaling down relative to the outer contour shape of the cross section of said first end portion 23 of said guide shaft 21, that is, the integral outer contour shape formed by said first end portion 23 of said guide shaft 21 and said second end portion 34 of said guide shaft 31 as a whole is tapered.

Referring to FIGS. 1-7, the electric fin 1 further comprises a driving member 40, said driving member 40, said propeller 20 and said flow guide 30 are arranged in sequence in said first direction, at least part of said driving member 40 is located in said water inlet cavity 11, and said driving member 40 is configured to drive said propeller 20 to rotate. Preferably, along the first direction, one end of the driving member 40 is located in the water inlet cavity 11, and the other end extends out of the water inlet cavity 11. In the present embodiment, the driving member 40 is partially located outside the housing 10. Preferably, the driving member 40 is a motor. The propeller 20 is driven by the driving member 40 to rotate, to propel the water flow in the water inlet cavity 11 to flow along the A direction in FIG. 6, thereby generating a reverse driving force to drive the water sports instrument where the electric fin 1 is provided forward.

Figure 4:
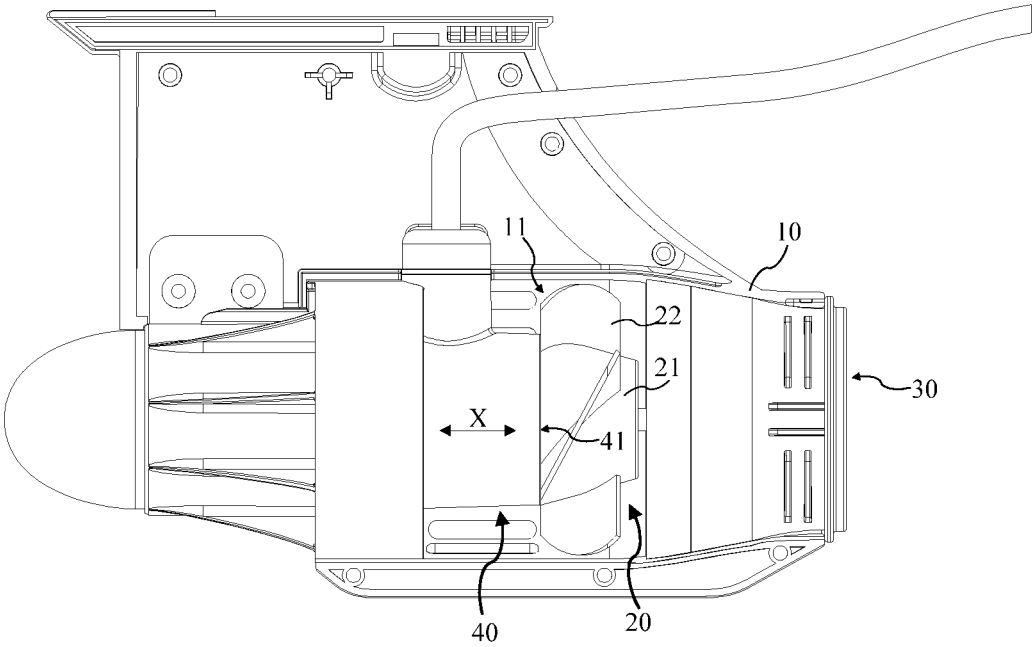
FIG. 4 is a side view of an electric fin of an embodiment of the present invention.

Referring to FIG. 4, along said first direction, said propeller shaft 21 comprises a second end portion 24, and said driving member 40 comprises a first end portion 41. Referring to FIGS. 6 and 9, said second end portion 24 of said propeller shaft 21 is in clearance fit with said first end portion 41 of said driving member 40 in said first direction. Preferably, the clearance in the first direction between said second end portion 24 of said propeller shaft 21 and said first end portion 41 of said driving member 40 is between 0.2 mm and 1 mm, including 0.2 mm and 1 mm. Said second end portion 24 of said propeller shaft 21 has a cross section having the same outer contour shape as that of the cross section of said first end portion 41 of said driving member 40, and projection of said second end portion 24 of said propeller shaft 21 and projection of said first portion 41 of said driving member 40 in the first direction coincide.

Figure 7:
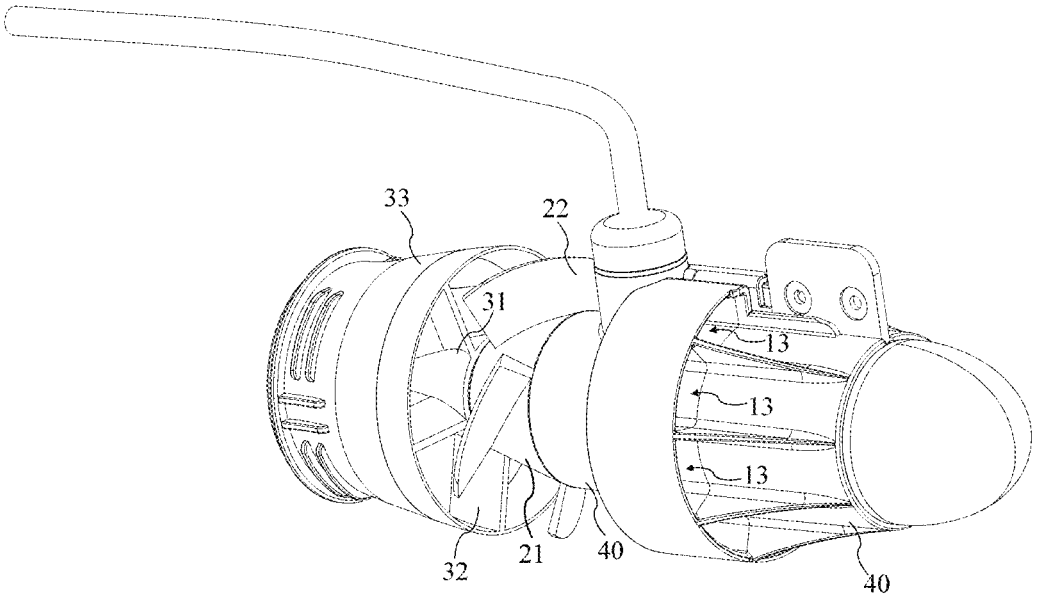
FIG. 7 is a three-dimensional view IV of an electric fin of an embodiment of the present invention.
Figure 8:
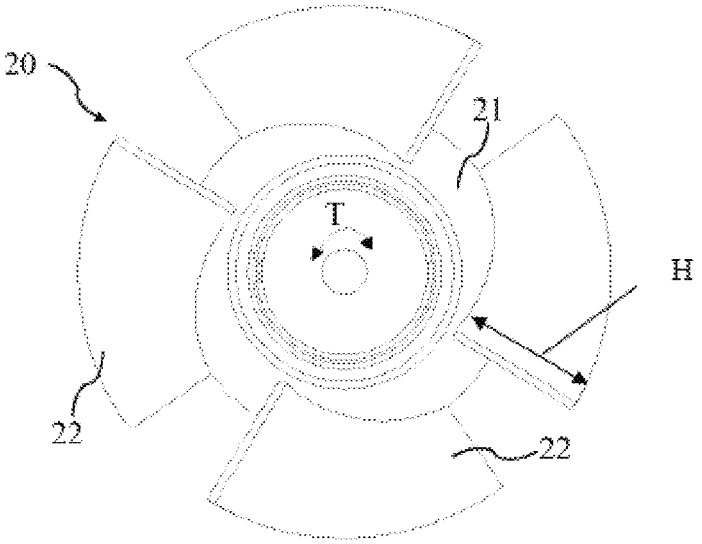
FIG. 8 is a side view I of a propeller in an electric fin of an embodiment of the present invention.

That is, referring to FIGS. 3 and 6-7, the propeller shaft 21 and the driving member 40 are in seamless connection, and they as a whole are streamlined. That is, referring to FIG. 6, a tangent line to an outer contour of the driving member 40 (shown as M in FIG. 6) is drawn, and the tangent line is tangent to said second end portion 24 of said propeller shaft 21. This design can avoid that the water is trapped in the junction of the propeller shaft 21 and the driving member 40, assisting in the water flow in the water inlet cavity 11 converges to the cavity center and extrudes, and then the water flow spirals into the flow guide 30 with increased speed and pressure, resulting in the power enhancement of the electric fin.

If the projection along the first direction of said second end portion 24 of said propeller shaft 21 is covered by the projection along the first direction of said first end portion 41 of said driving member 40, which means the transverse cross sectional area of said second end portion 24 of said propeller shaft 21 is smaller than the transverse cross sectional area of said first end portion 41 of said driving member 40, indicating that there is clearance at the junction of the propeller shaft 21 and the driving member 40, then water will be trapped in the junction, which is detrimental to the water flow in the water inlet cavity 11 to converge to the water inlet cavity center and extrudes.

More preferably, the outer contour shape of the cross section of said second end portion 24 of said propeller shaft 21 is scaling down relative to the outer contour shape of the cross section of said first end portion 41 of said driving member 40, which means the integral outer contour formed by said second end portion 24 of said propeller shaft 21 and said first end portion 41 of said driving member 40 is tapered.

Further, preferably, referring to FIGS. 3-4, 7 and 9, one end of each blade 22 along its extension direction is flush with the edge of said second end portion 24 of said propeller shaft 21. That is, one end of each blade 22 along its extension direction and said first end portion 41 of said driving member 40 are in seamless connection, and they as a whole are streamlined. This design makes the blade 22 of the propeller 20 shear more water, which further assist in the increase of water speed and pressure, leading to the water flow flows out of the flow guide 30 with a higher speed and thus the enhanced power of electric fin 1.

Preferably, the outer contour shape of the cross section of the part of said driving member 40 located in said water inlet cavity 11 is the same as the outer contour shape of the cross section of said first end portion 41 of said driving member 40, that is, the part of the driving member 40 located in the water inlet cavity 11 has a invariable cross section.

Referring to FIGS. 3, 6-7 and 10-12, said flow guide 30 of the present invention is provided with an annular wall 33, said annular wall 33 is fitted with the inside wall of said housing 10, one end of each flow deflector 32 is connected to the inside wall of said annular wall 33, the other end is connected to said guide shaft 31, the inside surface of said annular wall 33 (shown as Q in FIG. 6) has a taper which decreases gradually along said second direction (shown in the A-direction in FIG. 6).

That is, the inside wall of the annular wall 33 as a whole is tapered along the second direction and has a transverse cross sectional area that gradually decreases in size, which means the size of the inside wall of the annular wall 33 as a whole decreases gradually along the second direction. By using this design, the water flow entering into the water inlet cavity 11 converges to the center of the annular wall 33 and extrudes (shown by the dashed arrow in FIG. 6) instead of spreading out, then the water flow flows out of the flow guide 30 with increased speed and pressure, resulting in the water speed and pressure increase and thus the enhanced power of electric fin 1.

Preferably, the transverse cross sectional area of said annular wall 33 from the second end portion 36 of said annular wall 33 to the first end portion 37 of said annular wall 33 decreases gradually along said second direction. As shown in FIG. 6, the water flow in said water inlet cavity 11 flows into said flow guide 30 from said second end portion 36 and flows out of said flow guide 30 from said first end portion 37 along said first direction, and the first end portion 37 and the second end portion 36 of the annular wall 33 are located on opposite sides of the annular wall 33. Preferably, the cross section of said annular wall 33 is circular.

Preferably, referring to FIGS. 3, 7 and 10, each flow deflector 32 along its extension direction has one end that is flush with the edge of said second end portion 34 of said guide shaft 31, said second end portion 34 of said guide shaft 31 is disposed facing said propeller shaft 21. That is, one end of each flow deflector 32 along its extension direction and the propeller shaft 21 are in seamless connection. By using this design, once the water flow in the water inlet cavity 11 flows into the flow guide 30, the water flow is divided by the flow deflectors 32 of the flow guide 30, implementing the guiding of high-speed spinning water in the water inlet cavity 11, and further improving the guiding performance of the electric fin 1.

More preferably, referring to FIGS. 3, 7 and 10, the edge of the second end portion 34 of the guide shaft 31 is flush with the edge of the second end portion 36 of the annular wall 33. Such a design is more conducive to implementing the guiding of the high-speed whirling water flow in the water inlet cavity 11, and further improving the guiding performance of the electric fin 1. Further, preferably, the edge of the second end 34 of the guide shaft 31, the edge of the second end 36 of the annular wall 33, and one end in the extending direction of each flow deflector 32 are aligned. Such a design is further conducive to implementing the guiding of the high-speed whirling water flow in the water inlet cavity 11, and further improving the guiding performance of the electric fin 1.

Referring to FIGS. 1-2, 5 and 7, the outer surface of said housing 10 of the electric fin 1 in the present invention is provided with a plurality of second water inlets 12, and the plurality of second water inlets 12 are spaced around a circumference of the outer surface of said housing 10 (shown in the T-direction in FIG. 1). Along said first direction, one end of said housing 10 away from said flow guide 30 is provided with a plurality of first water inlets 13, and the plurality of first water inlets 13 are spaced-around a circumference of said housing 10. The water flow flows into the water inlet cavity 11 from the first water inlets 13, which elevates the water inlet volume and generates a forward (shown in the direction A in FIG. 6) suction force, ensuring that the water inlet cavity 11 has sufficient water inlet volume, then the water flow generates a greater pushing force, thus the power of the electric fin 1 is more sufficient.

Preferably, the outer surface of said housing 10 of the electric fin 1 in the present invention is provided with a plurality of second water inlets 12, and the plurality of second water inlets 12 are spaced around a circumference of the outer surface of said housing 10 (shown in the T-direction in FIG. 1). Alternatively, along the first direction, one end of said housing 10 away from said flow guide 30 is provided with a plurality of first water inlets 13, and the plurality of first water inlets 13 are spaced around a circumference of said housing 10.

Further, preferably, the housing 10 is provided around the driving member 40, the driving member 40 protrudes from the housing 10 along the first direction, and the plurality of first water inlets 13 are provided around the driving member 40.

Figure 13:
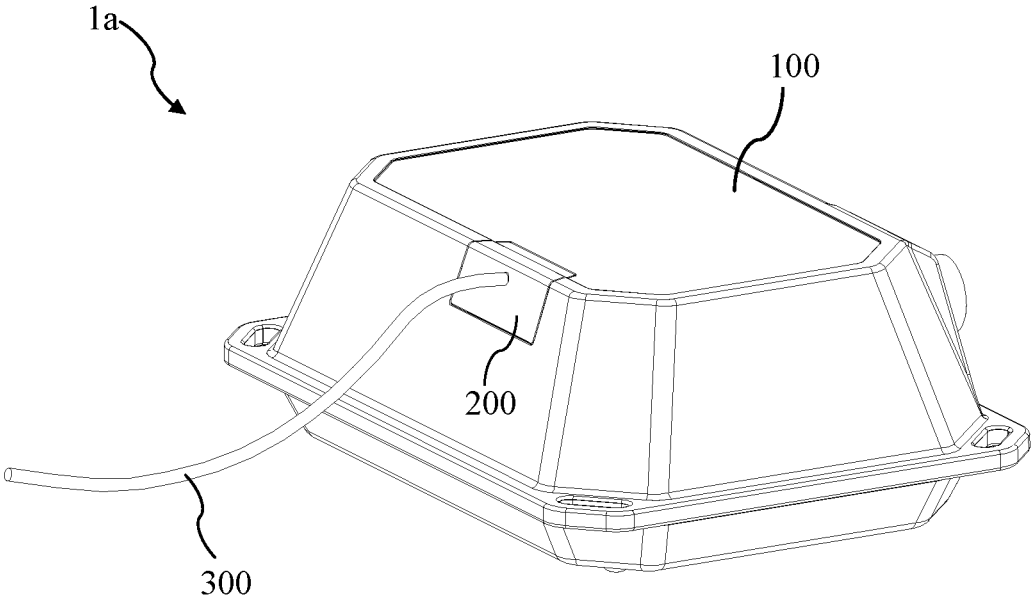
FIG. 13 is a three-dimensional view I of a power box of an embodiment of the present invention.
Figure 14:
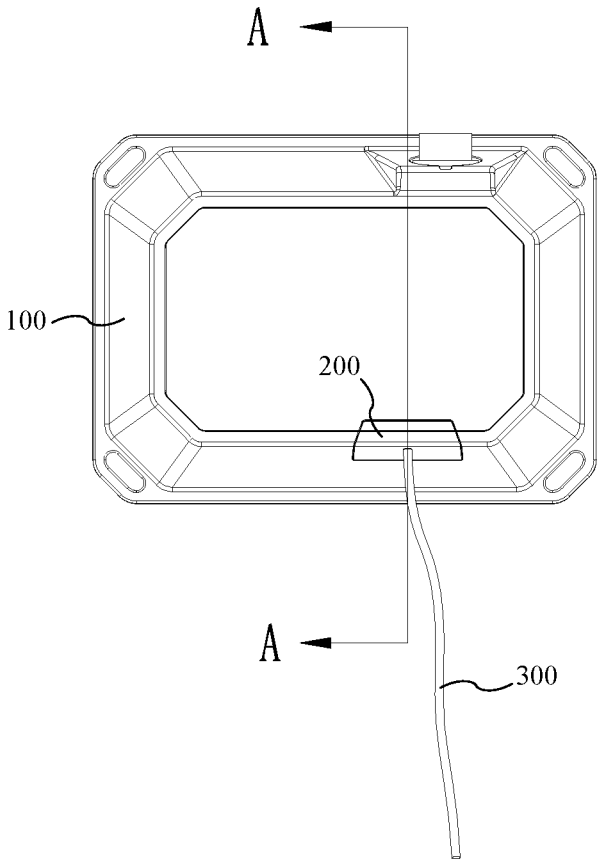
FIG. 14 is a top view of a power box of an embodiment of the present invention.

The present invention further provides a water sports instrument, comprising a bearing part (not shown) and the electric fin 1 described in any of the above embodiments, said electric fin 1 is mounted on the side of said bearing part facing the water flow. Said electric fin 1 is suitable for various water sports instruments. Accordingly, said bearing part can be a surfboard, a SUP and an inflatable boat, etc. Specifically, the electric fin 1 is connected to the bearing part by means of a mounting base 50. Preferably, the mounting base 50 is detachably connected to the bearing part. After the driving member 40 of the electric fin 1 is connected to a power box 1*a* (as shown in FIG. 13) via a power cord 60, the power is supplied to the driving member 40 via the power box 1*a*, then the driving member 40 can drive the electric fin 1 and thus drives the water sports instrument to move.

Referring to FIGS. 13-19, the present invention provides a power box 1*a*, preferably, the power box 1*a* is electrically connected to the electric fin 1 on the water sports instrument to drive the electric fin 1. The water sports instruments include surfboards, SUPs and inflatable boats, etc. The power box 1*a* comprises a housing 100, the housing 100 is provided with a connector 500, and the power cord 60 is connected to the electric fin 1 at one end and connected to the connector 500 at the other end.

A power supply 600 is provided in said housing 100. A power switch 200, provided on the outer surface of said housing 100, is movably connected to said housing 100. A sensor 110, provided on said housing 100, is connected to the power supply 600. When the sensor 110 senses that said power switch 200 is connected to said housing 100, said power supply 600 supplies power to external devices. Preferably, the external device is the electric fin 1. When the sensor 110 senses that said power switch 200 is detached from said housing 100, the power supply 600 stops supplying power to the external device.

Preferably, said power switch 200 is provided with a safe pulling rope 300, the safe pulling rope 300 is connected to a user at one end and is connected to the power switch 200 at the other end. Preferably, the safe pulling rope 300 is tied to the user's ankle.

Specifically, when the user is engaged in water sports, the user connects the power box 1*a* to the electric fin 1 via the power cord 60, and then the user is connected to the power switch 200 via the safe pulling rope 300. The power switch 200 is connected to the housing 100, and the sensor 110 senses that said power switch 200 is connected to said housing 100. In this case, the power supply 600 supplies power to the electric fin 1 (the external device), and the water sports instrument works normally.

Figure 16:
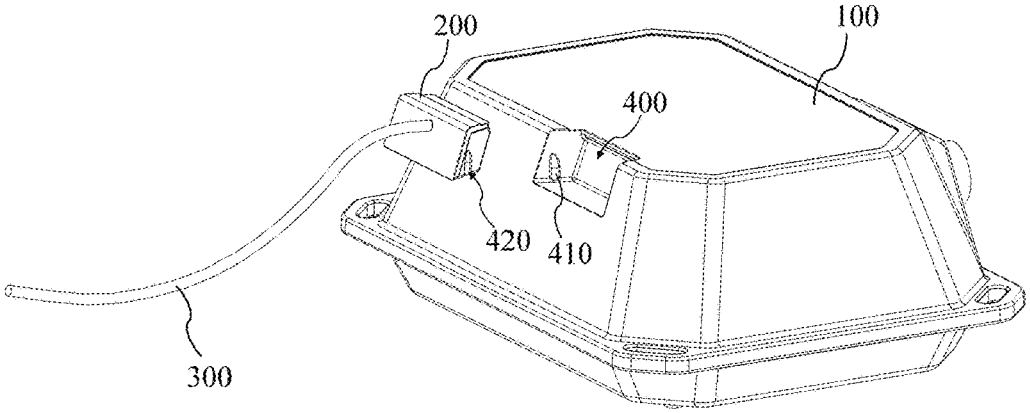
FIG. 16 is a three-dimensional view II of a power box of an embodiment of the present invention.
Figure 17:
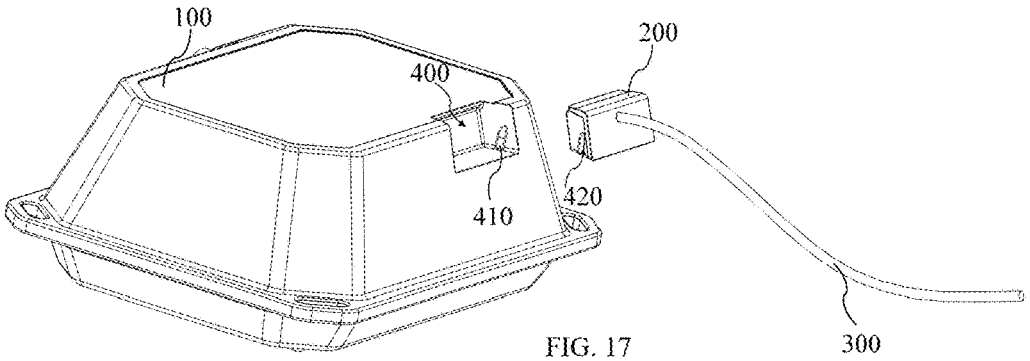
FIG. 17 is a three-dimensional view III of a power box of an embodiment of the present invention.
Figure 18:
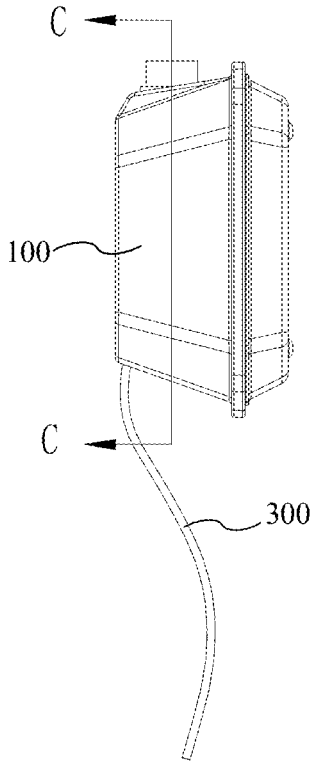
FIG. 18 is a side view of the power supply box of an embodiment of the present invention.
Figure 19:
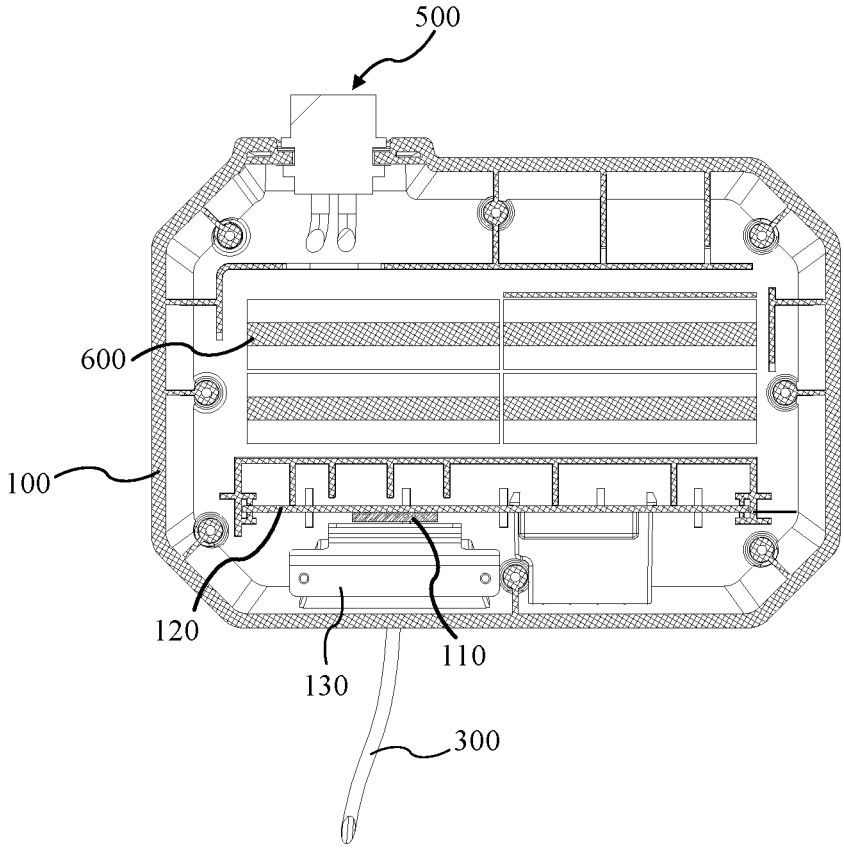
FIG. 19 is a cutaway view in the C-C direction in FIG. 18.

Referring to FIGS. 16-17, if the user accidentally falls into the water, since the power switch 200 is connected to the user via the safe pulling rope 300, after the user falls into the water, the user pulls the power switch 200 away from the housing 100 of the power box 1*a* via the safe pulling rope 300, the power switch 200 is detached from the housing 100, then said sensor 110 senses that said power switch 200 is detached from said housing 100, the power supply 600 stops supplying power to the electric fin 1, the water sports instrument stops working and is not away from the user. Therefore, the user can return to the water sports instrument, and the safety of using the power box 1*a* of the present invention is improved.

Figure 15:
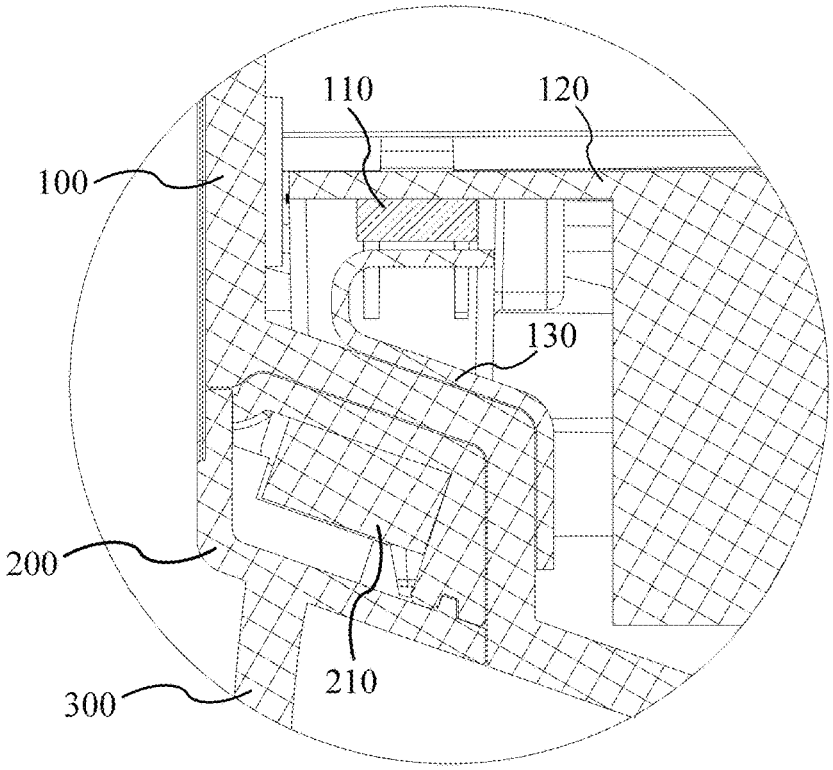
FIG. 15 is a cutaway view in the A-A direction in FIG. 14.

Referring to FIG. 15, said sensor 110 is a magnetic switch, and said power switch 200 is provided with a magnetic suction member 210. When said power switch 200 is connected to said housing 100, said magnetic suction member 210 is connected to the magnetic switch, the sensor 110 senses that said power switch 200 is connected to said housing 100, said magnetic switch is turned on, and said power supply 600 supplies power to the external device.

When said power switch 200 is detached from said housing 100, said magnetic suction member 210 is disconnected from said magnetic switch, said sensor 110 senses that said power switch 200 is detached from said housing 100, said magnetic switch is turned off, and said power supply 600 stops supplying power to the external device. That is, supplying power to external devices or not can be implemented via the power supply 600 by means of using the magnetic switch along with the magnetic suction member 210 and sensing whether there is a magnetic suction member 210 via the magnetic switch.

It should be noted that the sensor 110 is not limited to the magnetic switch, and any item that can sense whether the power switch 200 is connected to the housing 100 is acceptable. Preferably, the sensing member 110 is a Hall switch.

Preferably, said magnetic switch is provided in said housing 100, said housing 100 is further provided with a magnetic sensor 130. When said power switch 200 is connected to said housing 100, said magnetic sensor 130 is magnetically connected to said magnetic suction member 210, and the magnetic force generated by said magnetic suction member 210 can be transmitted from said magnetic sensor 130 to said magnetic switch. By providing the magnetic sensor 130, on the one hand, the sense of the sensor 110 that whether the power switch 200 is connected to the housing 100 is enhanced; on the other hand, the movable connection of the power switch 200 to the housing 100 is implemented since the magnetic sensor 130 is magnetically connected to said magnetic suction member 210.

Preferably, said magnetic sensor 130 is an iron sheet, and said magnetic suction member 210 is a magnet. The movable connection is implemented by magnetic adsorption of the magnet to the iron sheet.

Referring to FIG. 15, preferably, the magnetic suction member 210 is located in the power switch 200, and said magnetic sensing member 130 is at least partially affixed to the surface of said housing 100 back toward said power switch 200, and said magnetic suction member 210 is at least partially affixed to the surface of said housing 100 back toward said power switch 200. However, the form of the magnetic suction member 210 and the magnetic sensing member 130 is not limited in the present invention, and any form where the following conditions can be satisfied works: When said power switch 200 is connected to said housing 100, said magnetic sensing member 130 is magnetically connected to said magnetic suction member 210, and the magnetic force generated by said magnetic suction member 210 can be transmitted from said magnetic sensor 130 to said magnetic switch.

Referring to FIGS. 16-17, a containing part 400 is provided on the outer surface of said housing 100, and said containing part 400 contains said power switch 200. Preferably, after the power switch 200 is housed within the containing part 400 on the outer surface of the housing 100, referring to FIG. 13, the power switch 200 is flush with the outer surface of the containing part. The shape of the containing part 400 is not limited. Preferably, the containing part 400 is cylindrical. Accordingly, the power switch 200 is cylindrical. Further, preferably, the containing part 400 is provided on one side of the housing 100 and is actually the space formed on that side. That is, the containing part 400 includes three sequentially connected sides and the bottom connected to the three sides. The power switch 200 is cubic to fit into said containing part 400.

It is to be noted that the movable connection form of the power switch 200 to the housing 100 is not limited. As described above, the power switch 200 can be magnetically connected to the housing 100, so that the movable connection between the power switch 200 and the housing 100 can be implemented. Further, preferably, referring to FIGS. 16-17, said power switch 200 is in a snap-fit relationship with said containing part 400, said power switch 200 can be disconnected from said housing 400 under external forces. That is, the power switch 200 is in a snap-fit relationship with the containing part 400, and the movable connection of the power switch 200 and the housing 100 is implemented. The user can pull the power switch 200 away from the housing 100 by pulling the safe pulling rope 300.

Specifically, one of the side of said containing part 400 and the side of said power switch 200 is provided with a recess 420, the other is provided with a convex portion 410, and the recess 420 and the convex portion 410 are in a snap-fit relationship. In the present embodiment, the side of the containing part 400 is provided with the convex portion 410, the said of the power switch 200 is provided with the recess 420, and the recess 420 is snap-fitted to the convex portion 410. In other embodiments, the side of the containing part 400 is provided with the recess 420, the side of the power switch 200 is provided with the convex portion 410, and the convex portion 410 is snap-fitted to the recess 420. Referring to FIGS. 16-17, in the present embodiment, two convex portions 410 are provided separately on two opposing sides of the containing part 400, and two recesses 420 are provided separately on opposing sides of the power switch 200.

Referring to FIG. 15, a circuit board 120 is provided in said housing 100, said sensor 110 is provided on and connected to said circuit board 120, and said power supply 600 is connected to said circuit board 120.

In summary, the embodiments provided by the present invention are only illustrative description of the principles and effects of the present invention, and are not used to limit the present invention. Anyone familiar with this technology can modify or change the embodiments without departing from the spirit and scope of the present invention. Therefore, all equivalent modifications or changes made by those with ordinary knowledge in the technical field without departing from the spirit and technical ideas disclosed in the present invention should still be covered by the claims of the present invention.

What is claimed is:

1. An electric fin, comprising:

a housing, extending in a first direction and having a water inlet cavity;

a propeller and a flow guide sequentially arranged in said first direction, wherein said propeller is located in said water inlet cavity, at least part of said flow guide is located in said water inlet cavity, and a water flow in said water inlet cavity flows out of said flow guide;

said propeller is provided with a propeller shaft comprising a first end portion, a second end portion, and a plurality of blades, said propeller shaft extending in said first direction, and said plurality of blades being spaced around a circumference of said propeller shaft, each of said plurality of blades having a height "H" and extending helically about at least a portion of said propeller shaft and having a decreasing taper in said height H in a direction toward said flow guide;

said flow guide is provided with a guide shaft and a plurality of flow deflectors, said guide shaft extending in said first direction and said plurality of flow deflectors being spaced around a circumference of said guide shaft; and said propeller shaft and said guide shaft having an outer contour S with a taper which decreases gradually along a second direction from said second end portion of the propeller shaft toward said flow guide, wherein one end of each blade along its extension direction is flush with an edge of said second end portion of the propeller shaft.

2. The electric fin of claim 1, wherein said propeller shaft is in a truncated cone shape, and said guide shaft is also in the shape of a truncated cone.

3. The electric fin of claim 1, wherein a transverse cross sectional area of said propeller shaft decreases gradually in said second direction from said second end portion of said propeller shaft to said first end portion of said propeller shaft, the transverse cross sectional area of said guide shaft decreases gradually in said second direction from a second end portion of said guide shaft to a first end portion of said guide shaft, and said first end portion of said propeller shaft and said second end portion of said guide shaft are disposed adjacent to one another in said first direction.

4. The electric fin of claim 3, wherein said first end portion of said propeller shaft is fitted or in clearance fit with said second end portion of said guide shaft, said first end portion of said propeller shaft has a cross section having the same outer contour shape as that of the cross section of said second end portion of said guide shaft, and projection of said first end portion of said propeller shaft coincides with said second end portion of said guide shaft in the first direction; or the outer contour shape of the cross section of said second end portion of said guide shaft is scaling down relative to the outer contour shape of the cross section of said first end portion of said guide shaft.

5. The electric fin of claim 1, further comprising a driving member, wherein said driving member, said propeller and said flow guide are arranged in sequence in said first direction, at least part of said driving member is located in said water inlet cavity, and said driving member drives said propeller to rotate;

along said first direction, said propeller shaft comprises said second end portion, said driving member comprises a first end portion and a second end portion, said second end portion of said propeller shaft is in clearance fit with said first end portion of said driving member in said first direction, said second end portion has a cross section having the same outer contour shape as that of a cross section of said first end portion, and said second end portion coincides with said first end portion in the first direction; or the outer contour shape of the cross section of said second end portion of said propeller shaft is scaling down relative to the outer contour shape of a cross section of said first end portion of said driving member.

6. The electric fin of claim 5, wherein the outer contour shape of the cross section of a part of said driving member located in said water inlet cavity is the same as the outer contour shape of the cross section of said first end portion.

7. The electric fin of claim 1, wherein said flow guide includes an annular wall having opposing exterior and interior surfaces, said exterior surface is fitted with an inside wall of said housing, each flow deflector has one end that is connected to said interior surface of said annular wall, and the other end that is connected to said guide shaft.

8. The electric fin of claim 7, wherein the annular wall has a transverse cross sectional area that decreases gradually from a second end portion of said annular wall to a first end portion of said annular wall along said second direction, and the water flow in said water inlet cavity flows into said flow guide from said second end portion and flows out of said flow guide from said first end portion.

9. The electric fin of claim 8, wherein the water flow of said water inlet cavity flows out of said flow guide along said first direction.

10. The electric fin of claim 8, wherein each said flow deflector along its extension direction has one end that is flush with an edge of said second end portion of said guide shaft, and said second end portion of said guide shaft is disposed facing said propeller shaft.

11. The electric fin of claim 1, wherein along said first direction, one end of said housing away from said flow guide is provided with a plurality of first water inlets, said plurality of said first water inlets are spaced around a circumference of said housing; or an outer surface of said housing is provided with a plurality of second water inlets, and said plurality of said second water inlets are spaced around the outer surface of said housing.

12. A water sports instrument, comprising: a bearing part, and electric fin of claim 1, wherein said electric fin is mounted on a side of said bearing part facing the water flow.

* * * * *